United States Patent [19]

Goloff et al.

[11] 3,988,081

[45] Oct. 26, 1976

[54] GROOVED COMPRESSION SEALS FOR ROTARY ENGINES

[75] Inventors: Alexander Goloff, East Peoria; George Butler Grim, Washington, both of Ill.

[73] Assignee: Caterpillar Tractor Co., Peoria, Ill.

[22] Filed: Feb. 21, 1975

[21] Appl. No.: 551,814

[52] U.S. Cl. ..... 418/142; 277/81 P

[51] Int. Cl.[2] ..... F01C 19/00

[58] Field of Search ..... 418/113, 120–122, 418/140–142; 277/81 P

[56] References Cited

UNITED STATES PATENTS

| | | | |
|---|---|---|---|
| 974,803 | 11/1910 | Delukacsevics | 123/8.49 |
| 3,174,274 | 3/1965 | Frye | 418/141 |
| 3,176,910 | 4/1965 | Bentele | 418/142 |
| 3,644,069 | 2/1972 | Stewart | 418/141 |
| 3,697,202 | 10/1972 | Reinhart | 418/142 |
| 3,718,412 | 2/1973 | McCormick | 418/142 |

FOREIGN PATENTS OR APPLICATIONS

| | | | |
|---|---|---|---|
| 721,481 | 2/1943 | Germany | 418/141 |
| 753,772 | 8/1956 | United Kingdom | 418/141 |

*Primary Examiner*—C. J. Husar
*Attorney, Agent, or Firm*—Wegner, Stellman, McCord, Wiles & Wood

[57] ABSTRACT

A variety of improved compression seals for rotary engines is disclosed. The rotary engine includes a housing having walls defining a combustion chamber, a rotor within the housing and having surfaces facing the housing walls, at least one compression seal having a side exposed to high pressure gases and carried by the rotor, the seal having a seal surface sealingly engaging and slidably contacting at least one of the housing walls. The improved seal is provided with a plurality of grooves each having a substantial dimension extending nonparallel to the direction of sliding contact of the seal surface with the wall it engages, with each groove terminating short of the side of the seal exposed to high pressure gases. The grooves assist in the building of a wear preventing oil film between the seal and the housing wall without establishing a leakage path for high pressure gases.

7 Claims, 2 Drawing Figures

10
12
14
16
18
20
22
24
26
28
30
32
34
36
38
42
44
46
2.
2.

10
14
16
22
26
28
32
34
36
38
40
42
44

GROOVED COMPRESSION SEALS FOR ROTARY ENGINES

BACKGROUND OF THE INVENTION

This invention relates to rotary engines and rotary compressors of similar geometry and, more particularly, to improved compression seals for such rotary mechanism. Prior art of possible relevance includes the following U.S. Pat. Nos.: Bentele, 3,176,910, granted Apr. 6, 1965; Reinhart et al., 3,697,202, granted Oct. 10, 1972; and McCormick, 3,718,412, granted Feb. 27, 1973.

Side seals carried by the rotors of trochoidal type engines and peripheral or circumferential seals on slant axis rotary engines serve as compression seals in such engines. Apex seals perform the same function, while "bolts" or "buttons" provide the same function at the end of an apex seal. Such side seals and bolts as well as the ends of apex seals are rubbed against their mating surfaces, the walls of the housing of the engine, at a relatively high rate in the longitudinal direction. As a consequence, such seals are prone to scuffing and rapid wear.

The present state of the art suggests a solution may be found primarily in the selection of better materials rather than determining the cause or causes of the problem.

While normally, a bolt will not scuff before the side seals, the bolt frictionally engages the housing walls and, consequently, is a source of heat which contributes to the buildup of temperature at the ends of the side seals which do scuff.

In a like manner, according to the state of the art, apex seals are made short enough to prevent the onset of scuffing at their ends, the intentionally designed gap contributes to gas leakage which, in turn, decreases the efficiency of the engine. When such a gap is minimized to increase efficiency, when the engine is operating under severe conditions, the ends of the apex seals will approach the housing walls and initiate undesirable scuffing and wear.

SUMMARY OF THE INVENTION

It is the principal object of the invention to provide a new and improved rotary mechanism having improved compression seals. More specifically, it is an object of the invention to provide such compression seals wherein scuffing is minimized by means of a seal construction that aids in the building of an oil film at the point of contact of the seal with the housing.

The invention is applicable to rotary engines of various types including both trochoidal type engines and slant axis rotary engines and similarly configured rotary compressors. In an exemplary embodiment, the invention is employed in a rotary engine having a housing with walls defining a combustion chamber. A rotor is within the housing and includes surfaces facing the walls. At least one compression seal is carried by the rotor and has a side exposed to high pressure gases. The seal also includes a seal surface sealingly engaging the slidably contacting at least one of the walls.

The improvement in the seal resides in the provision, on the seal surface, of a plurality of grooves, each having a substantial dimension extending non-parallel to the direction of sliding contact of the seal surface with the wall that it engages. In addition, each such groove on the seal surface terminates short of the side of the seal exposed to the high pressure gases. The grooves assist in the building of a wear preventing oil film between the seal and the housing wall. By reason of their termination short of the high pressure side of the seal surface, they do not establish a leakage path for high pressure gases.

According to a highly preferred embodiment of the invention, the grooves extend transversely to the direction of sliding contact with the housing wall and may be employed in so-called end seals or on bolts or buttons.

The grooves may also be employed on the ends of apex seals, thereby allowing apex seals to be designed to minimize the heretofore accepted gap.

In a highly preferred embodiment, the grooves stop short of both sides of their respective seals to provide for simplicity in manufacture and assembly.

Other objects and advantages will become apparent from the following specification taken in connection with the accompanying drawings.

DESCRIPTION OF THE PREFERRED EMBODIMENT

Figure 1:
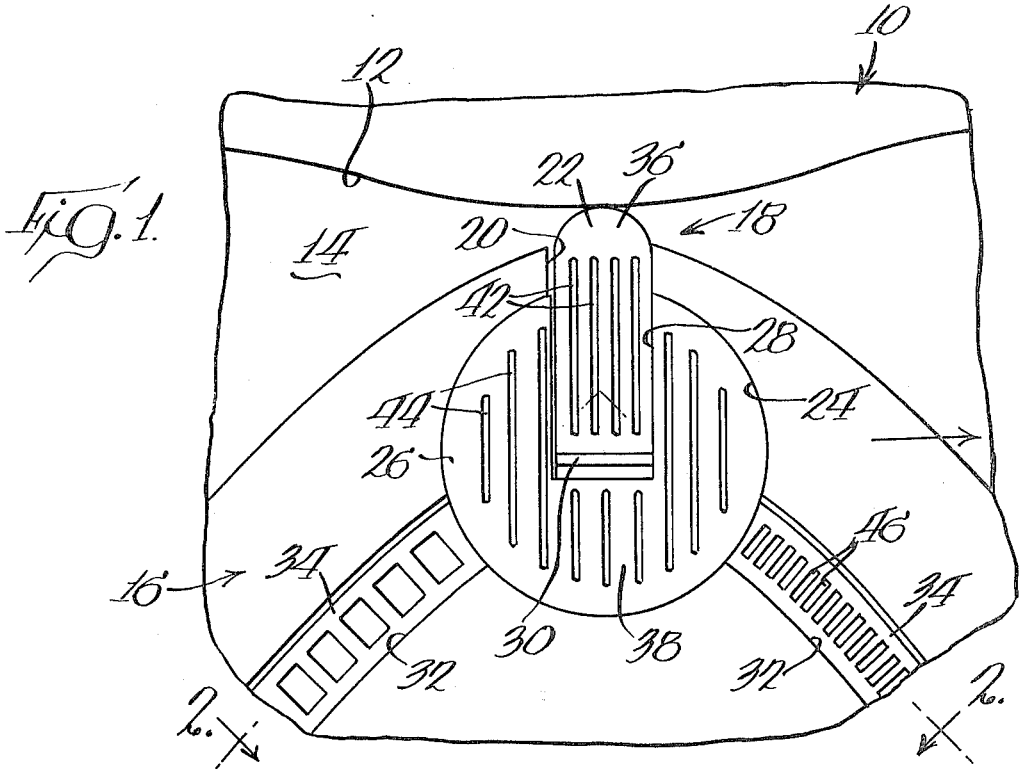
FIG. 1 is a fragmentary, side view of a rotary engine embodying the invention.
Figure 2:
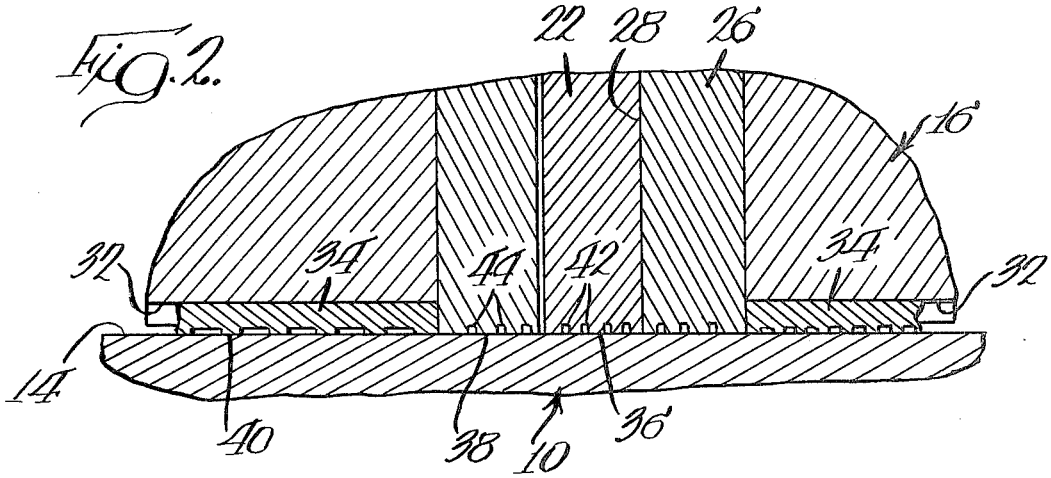
FIG. 2 is a fragmentary section taken approximately along the line 2—2 in FIG. 1.

An exemplary embodiment of a rotary engine employing improved compression seals made according to the invention is illustrated in FIGS. 1 and 2 and is seen to include a housing, generally designated 10, including first and second walls 12 and 14. In actuality, there are two of the walls 14 which are spaced so as to define, in connection with the wall 12, a chamber.

Within the chamber thus defined, there is disposed a rotor, generally designated 16, having a plurality of apices 18 (only one of which is shown). As will be apparent to those skilled in the art, the engine illustrated in FIG. 1 is of the trochoidal type. However, it is to be understood that the invention is not limited to trochoidal engines, but may be successfully employed in other rotary engines as, for example, a slant axis rotary engine, and similarly configured rotary compressors.

The rotor 16 is disposed on an eccentric (not shown) in a conventional fashion so as to convert expanding gases of combustion within the chamber into rotary energy in a conventional fashion.

Each apex 18 on the rotor 16 is provided with an outwardly opening slot 20 for receipt of an apex seal 22. In addition, circular bores 24 on opposite sides of the rotor 16 and adjacent each of the apices 18, may be provided for receipt of bolts or buttons 26 as is well known. Each bolt 26 includes a slot 28 for receipt of a portion of the corresponding apex seal 22. Extending through the slots 20 and 28 is an undulating spring 30 for biasing the apex seal 22 into engagement with the wall 12.

The sides of the rotor 16 are provided with further grooves 32 for receipt of end seals 34 in a conventional fashion.

Referring now specifically to FIG. 2, it will be seen that one end 36 only of the apex seal 22 may be in sealing engagement with a corresponding one of the side walls 14. Contact at both ends 36 is to be avoided, as thermal expansion during operation could result in undesirable scuffing.

Similarly, the bolt 26 includes a sealing surface 38 which also is in sealing and slidable contact with the corresponding one of the walls 14. Finally, each end seal 34 has a sealing surface 40 in sealing and slidable engagement with the wall 14.

Returning to FIG. 1, it will be seen that each end 36 of the apex seal 22 is provided with a plurality of elongated grooves 42 which extend in a direction non-parallel to the direction of sliding contact of the end 36 with the wall 14. Preferably, the direction of extension of the grooves 42 is generally transverse to the direction of sliding movement.

It will also be observed that each of the grooves 42 stops short of the sides of the apex seal 22 that are exposed to gases under pressure developed during operation.

Each bolt 26, on its surface 38, is provided with a plurality of similar grooves 44 generally arranged in the configuration shown. Again, it will be observed that the same extend in a direction generally non-parallel to the direction of sliding contact and are preferably transverse to the direction of sliding contact. It will also be observed that the grooves 44 stop short of extending to the side of the bolt 26 exposed to gas under high pressure during operation.

The side seals 34 are provided with a plurality of grooves 46 which also extend in a direction non-parallel to the direction of sliding contact and are preferably generally transverse to the direction of sliding contact. The grooves 46 also stop short of the side of the seal 34 subject to the high pressures of combustion gases.

In a highly preferred embodiment, for simplicity of assembly, the grooves in each of the apex seal 22, the bolt 26 and the end seals 34 stop short of the side of the respective seal opposite from the side thereof exposed to high pressure gases.

In general, while the grooves 42, 44, and 46 need not be elongated as illustrated, the same will generally have a substantial dimension extending transverse to the direction of sliding contact with the wall 14. For example, where geometry permits, the grooves could, for example, have a periphery such as that of a square.

The grooves 42, 44, and 46 are very shallow and can be formed in a variety of patterns. They may be produced by knurling, shot peening, a combination of shot peening and knurling, stamping, cutting, or by chemical etching. The purpose of the groove is to provide a deviation from geometrical flatness at the point of contact between the various seals and the associated housing wall. As a result of such a deviation, an oil film between the parts can exist to vastly minimize scuffing thereby reducing wear.

The purpose of forming the grooves so as to stop short of the side of the seal exposed to high pressure gases is to avoid the formation of a gas leakage path through the grooves. As a consequence, oil films are enhanced, thereby reducing wear while gas leakage is not introduced to thereby maintain efficiency during operation.

It will also be appreciated that while bolts and the ends of the apex seals do not ordinarily scuff as rapidly as the end seals, the use of grooves in the bolts or the ends of the apex seals provide an additional advantage. By reason of the use of the grooves in the bolts, there will be less friction between the bolts and the walls 14 with the result that the bolt 26 will run cooler. As a consequence, they will not act as a heat source for the ends of either the apex seals 22 or the side seals 34. As a result, localized thinning of the oil film is minimized thereby increasing wear resistance.

Similarly, with respect to the provision of the grooves 42 in the ends of the apex seals 22, it is possible to design the apex seals to run closer to the walls 14 without undesirable scuffing by reason of the improved oil film.

While the invention has been disclosed in connection with a trochoidal engine, it is to be appreciated that it is applicable to other rotary engines such as a slant axis rotary engine where parallel sealing surfaces are employed as, for example, in bolts. The same may also be employed in rotary compressors of similar configuration.

What is claimed is:

1. In a rotary mechanism including a housing having walls defining a chamber, a rotor within said housing and having surfaces facing said walls, and at least one compression seal having a side exposed to high pressure gases and carried by said rotor, said seal having a seal surface sealingly engaging and slidably contacting one of said walls, the improvement wherein said seal surface is provided with a plurality of grooves each having a substantial dimension extending non-parallel to the direction of sliding contact of said seal surface with said one wall, each said groove terminating short of said side of said seal exposed to high pressure gases, whereby said grooves assist the building of a wear preventing oil film between said seal and said one wall without establishing a leakage path for high pressure gases.

2. The rotary mechanism of claim 1 wherein said dimension extends generally transversely to said direction.

3. The rotary mechanism of claim 1 wherein said rotor has a plurality of apices and said seal is an elongated apex seal, there further being one such seal at each of said apices, said seal surface being disposed at each end of said apex seals.

4. The rotary mechanism of claim 2 wherein said rotor has a plurality of apices and said seal is a bolt for receipt of an apex seal.

5. The rotary mechanism of claim 2 wherein said seal is a rotor side seal, there being two said side seals, one on each side of said rotor.

6. The rotary mechanism of claim 1 wherein said seal surface is parallel to said one wall.

7. The rotary mechanism of claim 6 wherein said grooves further stop short of the seal side opposite said side exposed to high pressure gases.

* * * * *